US005139868A

United States Patent [19]

Mori et al.

[11] Patent Number: 5,139,868

[45] Date of Patent: Aug. 18, 1992

[54] RECORDING MEDIUM AND IMAGE FORMING METHOD MAKING USE OF IT

[75] Inventors: Takahiro Mori, Yokohama; Masahiko Higuma, Tokyo; Hiroshi Sato, Yokohama, all of Japan

[73] Assignee: Canon Kabushiki Kaisha, Tokyo, Japan

[21] Appl. No.: 470,583

[22] Filed: Jan. 26, 1990

[30] Foreign Application Priority Data

Jan. 27, 1989 [JP] Japan ..... 1-18003
Nov. 29, 1989 [JP] Japan ..... 1-311116

[51] Int. Cl.[5] ..... B41M 5/00

[52] U.S. Cl. ..... 428/327; 346/1.1; 346/135.1; 428/195; 428/341; 428/500

[58] Field of Search ..... 346/1.1, 135.1; 428/195, 475.2, 478.2, 689, 211, 327, 340, 341, 500

[56] References Cited

U.S. PATENT DOCUMENTS 4,542,059 9/1985 Toganoh et al. ..... 428/211
4,550,053 10/1985 Arai et al. ..... 428/195
4,649,064 3/1987 Jones ..... 428/195
4,701,837 10/1987 Sakaki et al. ..... 428/195

FOREIGN PATENT DOCUMENTS

0191645A3 8/1986 European Pat. Off. ..... 428/195

OTHER PUBLICATIONS

Patent Abstracts of Japan, vol. 11, No. 393, Dec. 23, 1987, JP 62-160275, Jul. 16, 1987.

*Primary Examiner*—Pamela R. Schwartz
*Attorney, Agent, or Firm*—Fitzpatrick, Cella, Harper & Scinto

[57] ABSTRACT

A recording medium comprises a substrate and an ink-receiving layer provided on said substrate, wherein said ink-receiving layer contains a reaction product of a gelling agent with a coupling agent. An image forming method comprises applying ink-jet recording to the recording medium, thereby forming an image.

18 Claims, No Drawings

RECORDING MEDIUM AND IMAGE FORMING METHOD MAKING USE OF IT

BACKGROUND OF THE INVENTION

1. Field of the Invention

The present invention relates to a recording medium that can achieve superior ink receptivity and blocking resistance even when ink is applied in a large quantity per unit area as in the case of forming a full-color image in a high density, and an image forming method making use of it.

The present invention further relates to a recording medium that can stably retain the above recording performance even after storage for a long period of time or at a high temperature and also has superior light-transmission properties, and an image forming method making use of it.

2. Related Background Art

Ink-jet recording has attracted notice as a recording process that makes less noise and enables high speed printing and multi-color printing.

Hitherto used as recording mediums in this ink-jet recording process are papers usually available, recording mediums called ink-jet recording papers, comprising a substrate and provided thereon a porous ink-receiving layer, and light-transmissive recording mediums used for OHPs (over-head projectors).

In recent years, with improved performance of ink-jet recording devices as in increasing high-speed and multi-color recording, properties of a higher grade and wider range have been increasingly required also with respect to the recording mediums.

In particular, it is necessary for the light-transmissive recording medium used in ink-jet recording to satisfy fundamental requirements that;

(1) the medium has excellent light-transmission properties;

(2) the medium has excellent ink absorptivity;

(3) dots are substantially round with smooth peripheries thereof;

(4) the dots have a high OD (optical density), and are free from unclearness around the dots;

(5) the medium has excellent blocking resistance; etc.

In particular, blocking may remarkably occur when a large quantity of ink is shot at one time onto the recording medium as in instances in which a recording head with a plurality of ink ejection openings (nozzles) is used and instances in which a full-color image is formed using inks of multiple colors. More specifically, the resin in the ink-receiving layer, having absorbed ink in a large quantity, is swelled and dissolved by the ink, which turns adhesive to cause the phenomenon that the resin adheres to the paper, plastic film or the like. This phenomenon is called a blocking phenomenon, and the property that may not cause the blocking even when a large quantity of ink is applied to the recording medium is called the blocking resistance.

Various studies have been hitherto made in order to satisfy the performance mentioned above, some of which have attained successful results to a certain degree. Under actual circumstances, however, no recording medium is known that has satisfied all of these required performances.

For example, U.S. Pat. No. 4,550,053 discloses a recording medium containing a condensation product of D-sorbitol with benzaldehyde. This condensation product is used in an amount of from 5 to 200 parts by weight based on 100 parts by weight of a polymeric material used in an ink-receiving layer.

In the materials used in the art as disclosed in the above publication, a recording medium in which the above condensation product comprises not less than 70 parts by weight based on 100 parts by weight of the polymeric material used in the ink-receiving layer can achieve a good blocking resistance.

However, storing this recording medium for a long period of time or at a high temperature brings about another problem that the above condensation product separates out of the ink-receiving layer to make it milky-white.

Ink-jet recording carried out on the above recording medium may also bring about additional problems of a low ink-absorption rate and a small initial dot size.

Namely, under actual circumstances, it has been difficult in the prior art to achieve both blocking resistance and storage stability.

SUMMARY OF THE INVENTION

Accordingly, an object of the present invention is to provide a recording medium that can achieve superior ink receptivity and blocking resistance even when ink is applied in a high density and large quantity, and to provide an image forming method making use of it.

Another object of the present invention is to provide a recording medium that can stably retain the above recording performance even after storage for a long period of time or at a high temperature and also has superior light-transmission properties, and to provide an image forming method making use of it.

The above objects can be achieved by the invention described below.

The present invention is a recording medium comprising a substrate and an ink-receiving layer provided on said substrate, wherein said ink-receiving layer contains a reaction product of a gelling agent with a coupling agent.

In another embodiment, the present invention is a recording medium comprising a substrate and an ink-receiving layer provided on said substrate, wherein said ink-receiving layer contains a hydrophilic resin, a reaction product of a gelling agent with a coupling agent, and a gelling agent.

In still another embodiment, the present invention is a recording medium comprising a substrate and provided thereon an ink-receiving layer containing highly water-absorptive resin particles having a water absorption power from 50 times to 1000 times their own weight and a binder, wherein said resin particles, protruding from the surface of a binder layer of said ink-receiving layer to a height of from 1 to 100 μm, are present in the number of 50 to 5000 per 1 $mm^2$ of the ink-receiving surface, and said binder layer contains a reaction product of a gelling agent with a coupling agent.

The present invention is also an image forming method comprising applying ink-jet recording to recording medium having an ink-receiving layer containing a reaction product of a gelling agent with a coupling agent, thereby forming an image.

DETAILED DESCRIPTION OF THE EMBODIMENTS

The present invention will be now described below in detail.

The recording medium of the present invention comprises a substrate and an ink-receiving layer, and is so constituted that the ink-receiving layer contains a reaction product (A) of a gelling agent with a coupling agent.

As the substrate used in the present invention, any substrates can be used so long as they are light-transmissive, including, for example, films or sheets of polyester resins, diacetate resins, triacetate resins, acrylate resins, polycarbonate resins, polyvinyl chloride resins, or polyimide resins, and glass sheets.

Next, the gelling agent used in the ink-receiving layer according to the present invention refers to a compound having the ability to lower the fluidity of water, alcohols, polyhydric alcohols and organic solvents contained in ink to solidify them.

In general, the mechanism of gelation is presumed that the hydrogen bonds formed between hydroxyl groups, amino groups and so forth of the gelling agent construct networks of compounds, and the desired solvent is entrapped between the networks.

The gelling agent used in the present invention include sorbitol derivatives as typified by a condensation product of sorbitol with benzaldehyde, isocyanate compounds, amino acid gelling agents as typified by N-lauroyl-L-glutamic acid-$\alpha,\gamma$-di-n-butylamide; agar, caraguinan, pectin, and gellan rubber.

In particular, in the ink-jet recording in which a water-based ink is preferably used, a condensation product of sorbitol with an aromatic aldehyde is suited, since it has an excellent gelation power for the water, alcohols and polyhydric alcohols in the ink and is chemically stable to the water content in the air.

As the sorbitol, D-types are readily obtainable, and hence D-sorbitol can be readily utilized.

The aromatic aldehyde includes benzaldehyde, halogenated benzaldehyde, tolualdehyde, salicylaldehyde, cinnamaldehyde, and naphthaldehyde. The condensation product of any of these compounds with sorbitol may be used alone or in combination of plural ones.

In particular, a condensation product of D-sorbitol with benzaldehyde is readily obtainable and has a high gelling effect. This is thus most preferred.

The condensation product of D-sorbitol with benzaldehyde can be synthesized by the condensation reaction between D-sorbitol and benzaldehyde. It is possible to synthesize products in which D-sorbitol and benzaldehyde are 1:1, 1:2 and 1:3 in molar ratios, but it is suited to use a product with the ratio of 1:2 or 1:3, and most suited to use a product with the ratio of 1:2.

In the condensation product of D-sorbitol with benzaldehyde, a product with the molar ratio of 1:2 is called dibenzylidene sorbitol (trade name: Gelol D; a product of Shin-Nippon Chemical Industries Co., Ltd.); and a product with the ratio of 1:3, tribenzylidene sorbitol (trade name: Gelol T; a product of Shin-Nippon Chemical Industries Co., Ltd.).

The dibenzylidene sorbitol is a chemically neutral compound. It shows solubility (of about 20% by weight) to solvents such as N-methylpyrrolidone, N,N-dimethylformamide, and dimethyl sulfoxide, but shows a small solubility to most solvents as exemplified by ethyl alcohol, isopropyl alcohol, ethylene glycol, glycerol, diethylene glycol, benzyl alcohol, ethyl cellosolve, tetrahydrofuran, dioxane, cyclohexylamine, aniline, and pyridine. It has the property that when dissolved by heating and then cooled the solution is gelled. In the present invention, this gelling power (the power to gel or solidify a liquid) possessed by the above condensation product is utilized to suppress the fluidity of low-volatile solvents such as polyhydric alcohols contained in a recording solution when the ink-jet recording is carried out, thus achieving the fixing of the recording solution.

The coupling agent used in the present invention is used for the purpose of improving the compatibility between other polymers and the gelling agent. It specifically includes polyisocyanate compounds, polyepichlorohydrine compounds, and polymethylol compounds. There can be used, for example, polyisocyanate compounds as typified by 2,4-tolylenediisocyanate, 2,6-tolylenediisocyanate, diphenylmethane-4,4'-diisocyanate, hexamethylene diisocyanate, dicyclohexylmethane-4,4'diisocyanate, isophorone diisocyanate, and adducts of these.

The polyepichlorohydrine compounds also include polyglycerol polyglycidyl ether, pentaerythritol polyglycidyl ether, diglycerol polyglycidyl ether, triglycidyltris(Z-hydroxyethyl)isocyanate, glycerol polyglycidyl ether, and sorbitol polyglycidyl ether.

The polymethylol compounds include trimethylolmelamine, methylolated benzoguanamine, methylolated acetoguanamine, and methylolated phenol.

The reaction between the gelling agent and coupling agent can be carried out by known methods. More specifically, the two kinds of compounds may be mixed to cause them to react, or a reaction catalyst may be used in combination to carry out the reaction by heat and so forth. The respective gelling agent and coupling agent may be previously added in a coating composition to cause them to react when heated and dried after coating. However, particularly when the reaction is accompanied with no cross-linking reaction, it is also possible to add them in the coating composition after they have been reacted. The gelling agent and the coupling agent may be preferably in a ratio (gelling agent-/coupling agent) of not less than ½ and not more than 1/10, and more preferably not less than 1/1 and not more than 1/10.

For the purpose of further improving ink absorptivity, it is also possible to introduce a hydrophilic or water-soluble compound into the above reaction product.

The hydrophilic or water-soluble compound used in the present invention includes polyether diols as typified by polyethylene glycol, polypropylene glycol, an ethylene glycol/propylene glycol random copolymer, and an ethylene glycol/propylene glycol block copolymer. It is also possible to use a compound in which the terminal of the above polyether diol has been modified with a carboxylic acid, an amino group or a glycidyl group.

The compound also includes polyester diols as typified by an ethylene glycol/oxalic acid copolymer, an ethylene glycol/malonic acid copolymer, an ethylene glycol/succinic acid copolymer, and an ethylene glycol/adipic acid copolymer. Polyester diols in which the above ethylene glycol components have each been replaced by polypropylene glycol can also be used. It is also possible to use in the present invention a compound in which the terminal of the above polyester diol has been modified with a carboxylic acid, an amino group or a glycidyl group.

The reaction product of the gelling agent with the coupling agent, suitably used in the present invention, may preferably have a molecular weight of from 800 to 1000000. A molecular weight less than 800 may cause the problem of poor storage stability when the recording medium is stored for a long period of time and at a high temperature. On the other hand, a molecular weight larger than 100000 may cause the problems that the number of the terminal functional groups contributory to the exhibition of the gelling power is extremely decreased, the gelling power is lowered when the ink is applied in a large quantity, and the blocking resistance is lowered.

The hydrophilic or water-soluble compound may also be held in the above reaction product of the gelling agent with the coupling agent preferably in a content of from 10 to 70% by weight.

A content thereof less than 10% by weight may result in an insufficiency in ink absorptivity of the reaction product, making it necessary to additionally use the hydrophilic or water-soluble compound in combination so that the insufficiency can be compensated.

On the other hand, a content larger than 70% by weight brings about a sufficient ink absorptivity of the reaction product, but may result in a lowering of the gelling power because of water-soluble or hydrophilic segements when the ink is applied in a large quantity, bringing about the problem that the blocking resistance is lowered.

The above reaction product may preferably be terminated with the gelling agent on its end. This enables satisfactory exhibition of the gelling power of the reaction product, giving the combination structure that can achieve the blocking resistance as aimed in the present invention.

The reaction product (A) of the gelling agent with the coupling agent according to the present invention may preferably be contained in an amount ranging from 10 to 70% by weight based on the total weight of the ink-receiving layer. In other words, an amount less than 10% by weight, of the reaction product (A) may result in a small gelling power of the reaction product (A), bringing about the disadvantage that other resins used in combination tend to actually turn adhesive to make poor the blocking resistance when the ink is applied in a large quantity.

On the other hand, an amount more than 70% by weight, of the reaction product (A) may result in an extreme lowering of the ink absorption rate and hence in a prolonged ink-fixing time, making it impossible to put the recording medium to practical use.

In addition to the reaction product (A) of the gelling agent with the coupling agent, an unmodified gelling agent may preferably be used in combination so that the blocking resistance can be further improved. Such an unmodified gelling agent, which is not coupled, may preferably be contained in an amount ranging from 10 to 70% by weight based on the total weight of the ink-receiving layer.

The above reaction product (A) and the unmodified gelling agent may be contained in total in an amount of from 20 to 80% by weight based on the total weight of the ink-receiving layer.

An amount of less than 20% by weight, of the two compounds may result in a small gelling power of the unmodified gelling agent or the reaction product (A), bringing about the disadvantage of poor blocking resistance when the ink is applied in a large quantity.

On the other hand, an amount more than 80% by weight, of the reaction product (A) and unmodified gelling agent may result in an extreme lowering of the ink absorption rate and hence in a prolonged ink-fixing time, making it impossible to put the recording medium to practical use.

Other components in the ink-receiving layer, used in the present invention, may be any materials so long as they are materials capable of absorbing the water-based ink and fixing the dyes in the ink. Since, however, the ink is of aqueous type, the materials are required at least to be hydrophilic resins (binders).

Such hydrophilic resins include, for example, natural resin such as albumin, gelatin, casein, starch, cationic starch, gum arabic, and sodium alginate, synthetic resins such as carboxymethyl cellulose, hydroxyethyl cellulose, ion-modified hydroxyethyl cellulose, polyamide, polyacrylamide, polyethyleneimine, polyvinyl pyrrolidone, quaternized polyvinyl pyrrolidone, polyvinylpyridium halide, melamine resins, phenol resins, alkyd resins, polyurethanes, polyvinyl alcohols, ion-modified polyesters, sodium polyacrylate, polyethylene oxide, and poly-2-hydroxyethyl methacrylate, or hydrophilic polymers made water-insoluble by the cross-linking of these polymers, hydrophilic and water-insoluble polymer complexes comprising two or more polymers, and hydrophilic and water-insoluble polymers having hydrophilic segments.

Of these hydrophilic resins, the polyvinyl pyrrolidone is particularly preferred because it has a high compatibility with the reaction product previously described and also enables use of the reaction product in a high content.

The ink-receiving layer as described above is required to be provided by coating to have a thickness ranging from 1 to 100 μm, preferably from 1 to 50 μm, and more preferably from 2 to 30 μm, in dried coating thickness.

A highly water-absorptive resin particles may be further used in the ink-receiving layer so that the problem of beading can be solved.

The beading mentioned in the present invention is a phenomenon in which the ink absorption rate or speed can not overtake the recording speed when a large quantity of ink is applied to the recording medium, bringing about irregular agglomeration of the ink rich in fluidity to cause uneveness in concentration. In particular, an extreme beading results in a great prolongation of the apparent ink-fixing time, and hence has become a great subject of discussion with recent progress of the increasingly high-speed recording.

The highly water-absorptive resin particles used in the ink-receiving layer are resin particles having a water absorption power from 50 times to 1000 times their own weight. They specifically include, as disclosed in Japanese Patent Application Gazettes Laid-Open No. 173194/1982 and No. 24492/1983, sodium polyacrylate, vinyl alcohol/acrylamide copolymers, sodium acrylate/acrylamide copolymers, cellulose-type polymers (carboxymethyl compound, graft polymer), starch-type polymer (hydrolysate of acrylonitrile grafted polymer, acrylic acid grafted polymer), isobutylene/maleic anhydride copolymers, vinyl alcohol/acrylic acid copolymers, and polyethylene oxide modified products.

It is desirable for such particles to have an average particle diameter ranging from 1 to 100 μm, preferably from 5 to 50 μm, and more preferably from 10 to 30 μm, from the viewpoints of smooth touch on the surface with low-haze, of the ink-receiving layer to be formed, uniform and high ink absorption rate thereof, and uniform resolution.

The condition in which the resin particles are present may preferably be such that resin particles protruding from the surface of the ink-receiving layer to a height of from 1 to 100 μm are present in the number of 50 to 5000 per 1 $mm^2$ of the ink-receiving surface.

The resin particle number otherwise less than 50/$mm^2$ on the ink-receiving surface may result in a poorness in the effect attributable to the highly water-absorptive resin particles used, tending to cause the beading. On the other hand, use of the highly water-absorptive resin particles in the number more than 5000/$mm^2$ may bring about no beading but result in a great lowering of the light-transmission properties of the recording medium, and hence there is the problem that the resulting recording medium is so opaque for the recording medium used for an OHP that it is not worthy of practical use.

In the present invention, resins such as SBR latex, NBR latex, polyvinyl formal, polymethyl methacrylate, polyvinyl butyral, polyacrylonitrile, polyvinyl chloride, polyvinyl acetate, phenol resins, and alkyd resins may further be optionally used to reinforce the strength of the ink-receiving layer and/or improve adhesion thereof to the substrate.

In order to enhance the ink absorptivity of the ink-receiving layer, it is also possible to disperse fillers of various types to the extent that the light-transmission properties may not be impaired, which fillers are exemplified by silica, clay, talc, diatomaceous earth, calcium carbonate, calcium sulfate, barium sulfate, aluminum silicate, synthesized zeolite, alumina, zinc oxide, lithopone, and satin white.

It is also effective to further incorporate anionic, nonionic or cationic surface active agents into the ink-receiving layer to control the ink dot size at the time of recording, accelerate the ink absorption, and prevent tackiness of printed areas.

The recording medium is formed using the main materials as described above. In a preferred embodiment, both the substrate and the ink-receiving layer are light-transmissive and have a haze of not more than 50%, and the recording medium is transparent as a whole.

The recording medium according to this embodiment can particularly have excellent light-transmission properties, and can be mainly used when a recorded image is projected on a screen or the like through optical equipment, as in OHPs or the like. Thus, it is useful as a recording medium for transmitted-light viewing.

Such a light-transmissive recording medium can be prepared by forming on the light-transmissive support as previously described, a light-transmissive ink-receiving layer comprised of at least the binder and highly water-absorptive resin particles previously described.

A method of forming such an ink-receiving layer may preferably include a method comprising dissolving or dispersing the above binder and highly water-absorptive resin particles or a mixture thereof with other polymers or additives in a suitable solvent to prepare a coating solution, and coating said coating solution on the light-transmissive ink-receiving layer by a known coating method such as roll coating, rod-bar coating, spray coating, or air-knife coating, followed by drying immediately thereafter.

The recording medium of the embodiment thus formed is the light-transmissive recording medium having sufficient light-transmission properties.

The term "sufficient light-transmission properties" as used in the present invention means that the recording medium has a haze of not more than 50%, and preferably not more than 20%.

The haze not more than 50% makes it possible to view a recorded image by projecting it on a screen through an OHP, an also to view with sharpness the details of the recorded image.

In the present invention, the recording medium according to any of the embodiments as described above may be provided on its recording surface with an organic or inorganic fine powder in an amount of from about 0.01 to about 1.0 g/$m^2$. This can achieve further improvements in that the resulting recording mediums can more smoothly travel through a printer, can be more prevented from blocking when piled up, and can be better proof against fingerprints.

In the above, the present invention has been described by giving typical embodiments of the recording medium of the present invention. Of course, however, the recording medium of the present invention is by no means limited to these embodiments. In any of the embodiments, various known additives such as dispersants, fluorescent dyes, pH adjusters, anti-foaming agents, lubricants, and antiseptics may be incorporated in the the ink-receiving layer.

The recording medium of the present invention may not necessarily be colorless, and may be a colored recording medium.

The recording medium of the present invention as described above shows superior ink receptivity, and gives a recorded image with superior sharpness.

Thus, sharp recorded images that are free from flow-out or strike-though of ink, cause no beading or bleeding and have high resolution can be obtained not only in monochromatic recording, but also in full-color image recording even when inks with different colors are applied overlapping each other on the same place in a short time.

The present invention can also provide a recording medium having excellent surface gloss that has not been attained in any conventional recording mediums for ink-jet recording, and also can be applied to uses other than the conventional surface-image viewing, as exemplified by the recording mediums used when a recorded image is viewed by projecting it on a screen or the like through optical equipment such as a slide projector or the OHP, color separation plates used in preparing positive plates in color printing, or CMFs used in color display such as liquid crystal display.

EXAMPLES

The present invention will be described below in greater detail by giving Examples. In the following, "part(s)" or "%" is by weight unless particularly mentioned.

SYNTHESIS EXAMPLES

Reaction products of the gelling agent with the coupling agent, according to the present invention, were synthesized in the following way.

Synthesis Example 1

In a three-necked flask, 356 g of dimethylformamide is put and the temperature is raised to 80° C. With thorough stirring, 71.6 g (0.2 mol) of Gelol D(a product of Shin-Nippon Chemical Industries Co., Ltd.; a 1:2 condensate of D-sorbitol with benzaldehyde) is added, and dissolved over a period of about 1 hour. Next, 30 mg of dibutyltin laurate (a urethane reaction catalyst) is dropwise added, and then 17.4 g (0.1 mol) of Collonate T-100 (a product of Nippon Polyurethane Industry Co., Ltd.; 2,4-tolylene diisocyanate) is also dropwise added over a period of about 30 minutes. After completion of the addition, the reaction mixture is further stirred at 80° C. for 2 hours.

The above reaction gave reaction product (1) of the gelling agent with the coupling agent.

Synthesis Example 2

In a three-necked flask, 1858 g of dimethylformamide is put and the temperature is raised to 80° C. With thorough stirring, 100 g (0.1 mol) of PEG1000 (a product of Sanyo Chemical Industries, Ltd.; polyethylene glycol with average molecular weight of 1000) is added, and dissolved over a period of about 30 minutes. Next, 30 mg of dibutyltin laurate is dropwise added, and then 348 g (0.2 mol) of Collonate T-100 is also dropwise added over a period of about 5 minutes. After completion of the addition, the reaction mixture is further stirred at 80° C. for 2 hours. Then, 71.6 g (0.2 mol) of Gelol D is dissolved over a period of about 30 minutes. After completion of the dissolution, the reaction mixture is further stirred at 80° C. for 2 hours.

The above reaction gave reaction product (2) of the gelling agent with the coupling agent.

Examples 1 to 9, Comparative Examples 1 to 6

The materials as shown in Table 1 with the formulation as also shown therein were mixed, dispersed and dissolved to prepare coating solutions. The coating solutions were each coated on a transparent substrate of a polyethylene terephthalate film of 100 μm thick, using a bar coater under conditions that may give a dried coating thickness of 4 μm (ink-receiving layer), followed by drying at 140° C. for 5 minutes. Light-transmissive recording mediums of Examples 1 to 9 according to the present invention and Comparative Examples 1 to 6 were thus obtained.

Ink-jet recording was carried out on each of the recording mediums of Examples and Comparative Example as shown in Table 1, by the use of a recording device having a bubble-jet recording head (ejection droplet volume: 30 pl; ejection frequency: 2 KHz) in which inks are bubbled to cause them to eject, using yellow, cyan, magenta and black inks with the following formulation.

| | |
|---|---|
| Yellow ink (formulation): | |
| C.I. Acid Yellow 23 | 3% by weight |
| Diethylene glycol | 30% by weight |
| Water | 67% by weight |
| Cyan ink (formulation): | |
| C.I. Direct Blue 86 | 3% by weight |
| Diethylene glycol | 30% by weight |
| Water | 67% by weight |
| Magenta ink (formulation): | |
| C.I. Acid Red 35 | 3% by weight |
| Diethylene glycol | 30% by weight |
| Water | 67% by weight |
| Black ink (formulation): | |
| C.I. Direct Black 19 | 3% by weight |
| Diethylene glycol | 30% by weight |

-continued

| | |
|---|---|
| Water | 67% by weight |

On the evaluation items shown in Table 1, measurement was made by the following methods:

(1) The content of the reaction product of the gelling agent with the coupling agent was measured by G.P.C. (gel permeation chromatography) when the reaction is accompanied with cross-linking. When accompanied with no cross-linking, the content was determined by calculation based on the equivalent relationship of reactive functional groups.

(2) The content of the unmodified gelling agent was measured by G.P.C. when the reaction is accompanied with no cross-linking. When accompanied with cross-linking, it was measured by immersing the recording medium in dimethylformamide at room temperature for 24 hours and then subjecting the extracted compound to G.P.C.

(3) The height of the protruded particles and the number of the particles per 1 $mm^2$ were measured using a three-dimensional surface roughness measuring instrument (SE-3FK, manufactured by Kosaka Kenkyusho Co.; detector tip diameter: R=2.0 μm; load: 30 mg). At this time, however, the highly water-absorptive resin particles projected to a height less than 1 μm from the binder layer are not included in the number N. Thus, the number of the particles projected to a height not less than 1 μm from the binder layer is measured.

(4) Ink fixing performance was evaluated by judgement on whether or not no ink adhered to fingers as a result of incorporation of ink into the ink-receiving layer, when the recording medium on which full dots of three colors of yellow, cyan and magenta had been recorded was exposed to hot air (100° C.; wind velocity: 1 m/sec; for 10 seconds) and thereafter the recorded image was touched. The case in which no ink adhered was evaluated as "A"; the case in which the ink adhered, as "C"; and the intermediary case, as "B".

(5) The blocking resistance was evaluated by judging whether or not the film noted infra was readily peeled, when the recording medium on which full dots of three colors of yellow, cyan and magenta had been recorded was exposed to hot air (100° C.; wind velocity: 1 m/sec; for 10 seconds) and thereafter a polyethylene terephthalate film was laminated on the recorded image under a pressure of 40 $g/cm^2$. The case in which the film was readily peeled was evaluated as "A"; the case in which rather large force was required to peel the film, as "C"; and the intermediary case, as "B".

(6) The beading was evaluated by visual judgement on solid printed areas. The case in which no beading was caused was evaluated as "A"; the case in which the beading was caused, as "C"; and the intermediary case, as "B".

(7) The haze was measured using a direct haze meter (manufactured by Toyo Seiki Seisaku-Sho, Ltd.) equipped with an optical system based on JIS K6714.

(8) To examine the haze after storage at high temperature and high humidity, the haze was measured according to the method (7) after the recording medium was airtightly enclosed in an aluminum-laminated polyethylene bag and stored therein for 200 hours under conditions of 60° C. and 90% RH.

TABLE 1

Examples

TABLE 1-continued

| | 1 | 2 | 3 | 4 | 5 | 6 | 7 | 8 | 9 |
|---|---|---|---|---|---|---|---|---|---|
| Materials and compositional ratio of recording medium, and ink-receiving layer thickness: | | | | | | | | | |
| Formulation of coating solution [parts by weight]: | | | | | | | | | |
| Resin in binder (PVP K-90)*1: | 40 | 45 | 40 | 35 | 50 | 40 | 40 | 45 | 40 |
| Gelling agent (Gelol D)*2: | 53 | 40 | 30 | 0 | 40 | — | 53 | 40 | 30 |
| Coupling agent (Collonate T-100)*3: | 7 | — | — | — | — | — | 7 | — | — |
| (Elastron E-37)*4: | — | — | — | — | 10 | — | — | — | — |
| Reaction product of gelling agent with coupling agent (Synthesis Example 1): | — | 15 | 30 | — | — | — | — | 15 | 30 |
| (Synthesis Example 2): | — | — | — | 65 | — | 65 | — | — | — |
| Highly water-absorptive resin particles (Sumicagel SP-510):*5: | 5 | 5 | 5 | 5 | 5 | 0 | 0 | 0 | 0 |
| Solvent (dimethylformamide): | 700 | 700 | 700 | 700 | 700 | 700 | 700 | 700 | 700 |
| Binder coating thickness [μm]: | 4 | 4 | 4 | 4 | 4 | 4 | 4 | 4 | 4 |
| Content in ink-receiving layer: | | | | | | | | | |
| Reaction product of gelling agent with coupling agent [wt. %] (1): | 35.8 | 15 | 30 | 65 | 18.2 | 65 | 35.8 | 15 | 30 |
| unmodified gelling agent [wt. %] (2): | 24.2 | 40 | 30 | 0 | 31.8 | 0 | 24.2 | 40 | 30 |
| Number of protruded highly water-absorptive resin particles [number/mm$^2$] (3): | 400 | 400 | 400 | 400 | 400 | 0 | 0 | 0 | 0 |
| Results of evaluation: | | | | | | | | | |
| Ink fixing performance (4): | A | A | A | A | A | A | A | A | A |
| Blocking resistance (5): | A | A | A | A | A | A | A | A | A |
| Beading (6): | A | A | A | A | A | B | B | B | B |
| Haze (7): | 11 | 10 | 10 | 12 | 11 | 4 | 3 | 3 | 3 |
| Haze after storage of high temperature and high humidity (8): | 12 | 13 | 12 | 12 | 11 | 5 | 4 | 4 | 4 |

| | Comparative Examples | | | | | |
|---|---|---|---|---|---|---|
| | 1 | 2 | 3 | 4 | 5 | 6 |
| Materials and compositional ratio of recording medium, and ink-receiving layer thickness: | | | | | | |
| Formulation of coating solution [parts by weight]: | | | | | | |
| Resin in binder (PVP K-90)*1: | 40 | 100 | 10 | 40 | 100 | 10 |
| Gelling agent (Gelol D)*2: | 60 | 0 | 90 | 60 | 0 | 90 |
| Coupling agent (Collonate T-100)*3: | — | — | — | — | — | — |
| (Elastron E-37)*4: | — | — | — | — | — | — |
| Reaction product of gelling agent with coupling agent (Synthesis Example 1): | — | — | — | — | — | — |
| (Synthesis Example 2): | — | — | — | — | — | — |
| Highly water-absorptive resin particles (Sumicagel SP-510):*5: | 5 | 5 | 5 | 0 | 0 | 0 |
| Solvent (dimethylformamide): | 700 | 700 | 700 | 700 | 700 | 700 |
| Binder coating thickness [μm]: | 4 | 4 | 4 | 4 | 4 | 4 |
| Content in ink-receiving layer: | | | | | | |
| Reaction product of gelling agent with coupling agent [wt. %] (1): | 0 | 0 | 0 | 0 | 0 | 0 |
| unmodified gelling agent [wt. %] (2): | 60 | 0 | 90 | 60 | 0 | 90 |
| Number of protruded highly water-absorptive resin particles [number/mm$^2$] (3): | 400 | 400 | 400 | 0 | 0 | 0 |
| Results of evaluation: | | | | | | |
| Ink fixing performance (4): | A | B | B | A | B | B |
| Blocking resistance (5): | A | C | A | A | C | A |
| Beading (6): | A | B | B | B | C | C |
| Haze (7): | 10 | 10 | 16 | 3 | 3 | 5 |
| Haze after storage of high temperature and high humidity (8): | 30 | 10 | 46 | 25 | 3 | 40 |

*1: Poly(N-vinyl-2-pyrrolidone); average molecular weight: 360000 (a product of G.A.F. Corp.)
*2: 1:2 Condensation product of D-sorbitol with benzaldehyde (a product of Shin-Nippon Chemical Industries Co., Ltd.)
*3: 2,4-Tolylene diisocyanate (a product of Sanyo Chemical Industries, Ltd.)
*4: Water-soluble block isocyanate compound (a product of Daiichi Kogyo Seiyaku Co., Ltd.)
*5: Polyvinyl alcohol/polyacryloyl ester copolymer cross-linked product; average particle diameter: 10 to 20 μm (a product of Sumitomo Chemical Co., Ltd.)

We claim:

1. A recording medium comprising a light-transmissive substrate and an ink-receiving layer provided on said substrate, wherein said ink-receiving layer contains a reaction product of a condensation product of sorbitol with benzaldehyde and a coupling agent.

2. A recording medium according to claim 1, wherein said reaction product is contained in an amount ranging from 10 to 70% by weight based on the total weight of the ink-receiving layer.

3. A recording medium according to claim 1, wherein said coupling agent is at least one compound selected from the group consisting of a polyisocyanate compound, a polyepichlorohydrin compound and a polymethylol compound.

4. A recording medium according to claim 1, wherein said ink-receiving layer further contains a hydrophilic resin.

5. A recording medium according to claim 4, wherein said hydrophilic resin is polyvinyl pyrrolidone.

6. A recording medium comprising a light-transmissive substrate and an ink-receiving layer provided on said substrate, wherein said ink-receiving layer has a thickness ranging from 1 to 100 μm, and contains a hydrophilic resin, a reaction product of a condensation product of sorbitol with benzaldehyde and a coupling agent, and a condensation product of sorbitol with benzaldehyde in an amount ranging from 10 to 70% by weight based on the total weight of the ink-receiving layer.

7. A recording medium according to claim 6, wherein said hydrophilic resin is polyvinyl pyrrolidone.

8. A recording medium according to claim 6, wherein said reaction product is contained in an amount ranging from 10 to 70% by weight based on the total weight of the ink-receiving layer.

9. A recording medium according to claim 6, wherein said coupling agent is at least one compound selected from the group consisting of a polyisocyanate compound, a polyepichlorohydrin compound and a polymethylol compound.

10. A recording medium comprising a light-transmissive substrate and provided thereon an ink-receiving layer containing highly water-absorptive resin particles having a water absorption power from 50 times to 1000 times their own weight and a binder, wherein said resin particles, protruding from the surface of a binder layer of said ink-receiving layer to a height of from 1 to 100 $\mu$m, are present in the number of 50 to 5000 per 1 $mm^2$ of the ink-receiving surface, and said binder layer contains a reaction product of a condensation product of sorbitol with benzaldehyde and a coupling agent.

11. A recording medium according to claim 10, wherein said reaction product is contained in the binder layer in an amount ranging from 10 to 70% by weight based on the total weight of the ink-receiving layer.

12. A recording medium according to claim 10, wherein said coupling agent is at least one compound selected from the group consisting of a polyisocyanate compound, a polyepichlorohydrin compound and a polymethylol compound.

13. A recording medium according to claim 10, wherein said ink-receiving layer further contains a hydrophilic resin.

14. A recording medium according to claim 10, wherein said ink-receiving layer further contains a condensation product of sorbitol with benzaldehyde in an amount ranging from 10 to 70% by weight based on the total weight of the ink-receiving layer.

15. An image forming method comprising the step of applying ink-jet recording to a recording medium having a light-transmissive substrate, and an ink-receiving layer containing a reaction product of a condensation product of sorbitol with benzaldehyde and a coupling agent, thereby forming an image.

16. An image forming method according to claim 15, wherein said ink-receiving layer further contains a hydrophilic resin.

17. An image forming method according to claim 15, wherein said ink-receiving layer further contains a condensation product of sorbitol with benzaldehyde in an amount ranging from 10 to 70% by weight based on the total weight of the ink-receiving layer.

18. An image forming method according to claim 15, wherein said ink-jet recording is a process utilizing a system in which ink droplets are ejected using heat energy.

* * * * *

UNITED STATES PATENT AND TRADEMARK OFFICE

CERTIFICATE OF CORRECTION

PATENT NO. : 5,139,868

DATED : August 18, 1992

INVENTOR(S) : Mori et al.

It is certified that error appears in the above-identified patent and that said Letters Patent is hereby corrected as shown below:

COLUMN 1:

Line 36, "that;" should read --that:--.

COLUMN 3:

Line 26, "caragui-" should read --carrageenan--; and

Line 27, "nan," should be deleted.

COLUMN 5:

Line 1, "1000000." should read --100000.--.

COLUMN 8:

Line 7, "an" (second occurrence) should read --and--;

Line 26, "the" should be deleted; and

Line 34, "strike-though" should read --strike-through--.

UNITED STATES PATENT AND TRADEMARK OFFICE

CERTIFICATE OF CORRECTION

PATENT NO. : 5,139,868

DATED : August 18, 1992

INVENTOR(S) : Mori et al.

It is certified that error appears in the above-identified patent and that said Letters Patent is hereby corrected as shown below:

COLUMN 10:

Line 50, "which" should read --which a--.

Signed and Sealed this

Fifth Day of October, 1993

*Attest:*

*Attesting Officer*

Bruce Lehman

BRUCE LEHMAN

*Commissioner of Patents and Trademarks*